United States Patent [19]

Bovenkamp et al.

[11] 4,259,899

[45] Apr. 7, 1981

[54] DEVICE FOR RECLAIMING PAINT OR LIKE MATERIAL, WHICH DURING THE SPRAYING THEREOF DOES NOT LAND ON THE OBJECT TO BE TREATED

[76] Inventors: Jan Bovenkamp, 12, Midlansdyk, Goënga; Jannes A. Melching, 16, Kasteelstraat, Oudkarspel, both of Netherlands

[21] Appl. No.: 964,864

[22] Filed: Nov. 30, 1978

[51] Int. Cl.[3] ..... B05C 15/00

[52] U.S. Cl. ..... 98/115 SB; 118/326; 118/DIG. 7

[58] Field of Search ..... 118/326, DIG. 7, 634; 98/115 SB; 55/241

[56] References Cited

U.S. PATENT DOCUMENTS

| | | | |
|---|---|---|---|
| 2,132,826 | 10/1938 | Ludwig | 98/115 SB |
| 2,267,426 | 12/1941 | Saunders et al. | |
| 2,337,983 | 10/1943 | Fisher | 55/241 X |
| 2,383,138 | 8/1945 | Ludwig, Sr. | |
| 2,527,139 | 10/1950 | Loney | 98/115 SB |
| 2,545,672 | 3/1951 | Pearson | 118/DIG. 7 |
| 3,341,016 | 9/1967 | Paasche | 210/73 |
| 4,022,385 | 5/1977 | Krueger | 239/592 |

*Primary Examiner*—John P. McIntosh

*Attorney, Agent, or Firm*—Schwartz, Jeffery, Schwaab, Mack, Blumenthal & Koch

[57] ABSTRACT

Process for reclaiming paint or a like material, which during the essentially horizontal spraying thereof does not land on the object to be treated, for reclaiming the respective part of the paint use being made of an approximately vertical wall, of which the upper edge is somewhat closer to the object to be treated than the lower edge, between the object and the wall an air stream being generated, which is directed essentially from top to bottom and which at its lowest point, under the lower edge of the wall, is bent off above a liquid bath, from which bath liquid is aspired, which at the upper edge of the reclaiming wall is brought thereon and runs down the wall, back into the liquid bath.

4 Claims, 3 Drawing Figures

Figure 2:
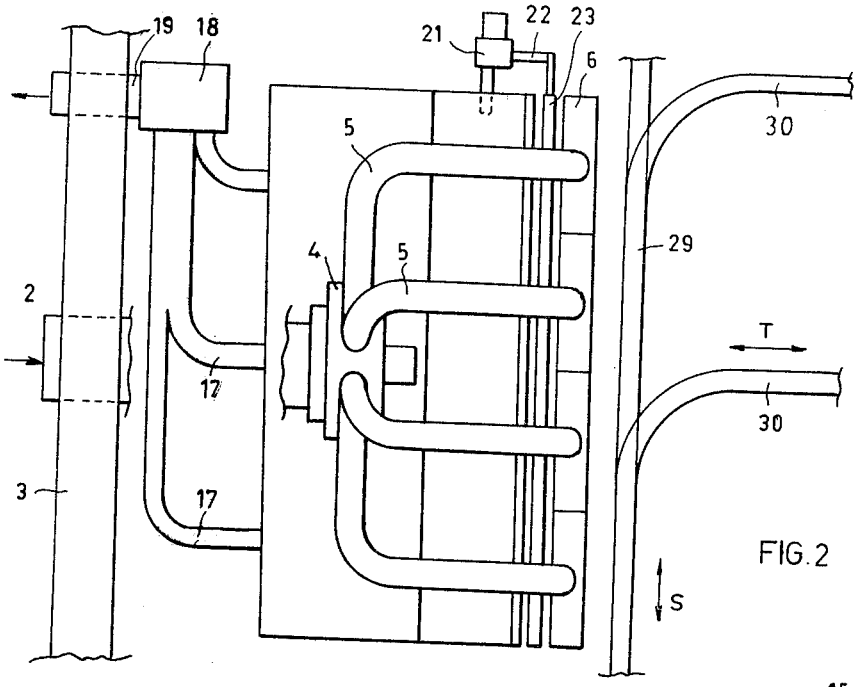

DEVICE FOR RECLAIMING PAINT OR LIKE MATERIAL, WHICH DURING THE SPRAYING THEREOF DOES NOT LAND ON THE OBJECT TO BE TREATED

The invention relates to an apparatus for reclaiming paint or like material, which during the essentially horizontal spraying thereof does not land on the object to be treated, use being made of an approximately vertically standing wall for reclaiming, at least partially, the respective part of the paint, which part of the paint is influenced by an air stream, whereas the reclaimed paint is removed from the wall.

With such a known process use is made of an essentially horizontal air stream, which travels in the same direction as the direction in which the paint or a like material is sprayed on the object to be treated. The paint that does not land on the object, is carried by the air stream and lands on the reclaiming wall, consisting of a frame with a filter material mounted thereon. The air stream passes through the filter material and the paint remains behind thereon.

Although the present invention is described mainly in connection with the spraying of paint or varnish, it will be obvious that the invention is not restricted thereto, but that the process and the device according to the present invention can be used also for spraying other materials, whereas the device may be adapted to the use of such materials.

In the case of the above-described known process, the air stream is subject to a considerable counter-pressure in the filter, especially when a certain amount of paint has been gathered thereon. Furthermore the air stream must be divided somewhat regularly over the entire surface of the reclaiming wall, which of course must have somewhat larger dimensions than the object to be treated. Therefore a relatively large amount of energy is necessary for generating the desired air stream.

Furthermore, the reclaimed paint must be removed from the wall and this is done by renewing the filter material. This implies that the device must be taken out of service from time to time. Moreover, the danger is always present that the filter material is torn in a certain place or is only perforated, and especially the latter will not always be observed directly. Finally, spontaneous ignition of the paint on the filter material may occur, so that such a process involves considerable dangers.

The present invention overcomes these drawbacks by providing a process, which is characterized in that the air stream is directed essentially vertically, from top to bottom between the object to be treated and the reclaiming wall, and is bent away at its lowest point above a liquid bath, from which bath liquid is sucked, which at the upper edge of the reclaiming wall is brought thereon and runs down the wall, back into the liquid bath.

It has appeared that the downwards directed air stream is capable of absorbing the greater part of the paint particles sprayed past the object, and where the air stream is bent away over the liquid bath, the greater part of the paint particles, because of their inertia, will end up in the liquid bath. The particles not carried along by the air stream will land on the reclaiming wall and are rinsed off that wall by means of liquid brought on the reclaiming wall.

Renewal of filter material and the standstill of the device caused thereby, are thus prevented, so that the operating cost can be reduced considerably.

Furthermore, an air stream needs to be generated only over a length corresponding with approximately the horizontal dimension of the reclaiming wall, whereas the width of this air stream may be relatively small. As the air stream experiences but little resistance and, particularly, needs not pass through the filter material and the paint possibly present thereon, the amount of energy necessary to generate the air stream will relatively be considerably smaller than the amount of energy, which is necessary with the known device to maintain the air stream. Therefore a considerable amount of energy is saved.

A further saving of energy resides in the fact that use can be made of outside air for generating the air stream. With the known devices this is usually impossible, because the person who sprays the paint is present in the generated air stream, so that use is made almost always of air which is aspired from the surrounding building. If this is not possible, it is often necessary to heat the air, in order to enable the operator to do his work. With the device according to the present invention, the operator is completely outside the air stream, so that the temperature of the aspired air plays almost no part. Only at extremely low outside temperatures might some heating of the air be necessary, but given the small amount of air used in the invention, this will hardly present objections.

When paint or varnish is sprayed, the liquid in the tank may be water, the cost of which is negligeable. Especially when the device is out of operation during the night, the paint particles reclaimed in the water will gather and form a "skin" on the water, which skin can be removed easily from the water.

Thus, a continuous renewal of the water will hardly be necessary, so that in this respect too, the process according to the present invention presents no dangers for the environment.

The invention also relates to a device for carrying out the above-described process. As the known device, the device according to the invention comprises at least one fan for generating the air stream, whereas according to the invention, this fan is connected to a distributing box, which extends itself horizontally over almost the entire horizontal dimension of the reclaiming wall and which is set up before the reclaiming wall and above and behind the object to be treated, and which is provided at its underside with outlet openings with guiding partitions provided therein, whereas under the distributing box and the reclaiming wall a liquid tank is provided, to the suction side of which a circulation pump is connected, which conveys the liquid from the tank to a distributing device provided at the upper edge of the reclaiming wall, which distributing device brings the liquid on the wall over the entire horizontal dimension of the wall.

According to a preferable embodiment of the device, the outlet openings and the guiding partitions are carried out in such a way, that a narrowly limited air stream is obtained, which widens conically from the opening, in such a way that the limitation plane, which is closest to the object to be treated, of the air stream runs almost vertically and that the other plane forms an angle between 10° and 20° therewith.

Such a narrowly limited air stream is desired, in the first place to prevent that the result of the treatment is influenced negatively by air streams around the object to be treated, whereas also the air near the reclaiming wall must not be brought into turbulent motion, which might cause the detachment of the liquid film flowing down over the reclaiming wall and the adherence of the paint particles to the reclaiming wall. As the object to be treated will in general be in a vertical plane, also the limitation plane which is closest thereto of the air stream will be almost vertical.

For reclaiming as equally as possible the paint particles that have not already been carried down by the air stream, the reclaiming wall will be set up preferably in such a way, that its reclaiming surface is almost parallel with the oblique limitation plane of the air stream and at some distance therefrom.

Particularly, the angle under which the reclaiming surface of the reclaiming wall is provided, may be 14°. Although the reclaiming wall is inclined forwards with respect to the liquid brought thereon, it has appeared in practice that the liquid can have sufficient adhesion with respect to the wall, so that no detachment of the liquid from the wall occurs. The paint particles landing on the wall, which essentially will have a horizontally directed speed component, will obtain, because of the inclined position of the reclaiming wall, a vertically downwards directed speed component.

According to a further elaboration of the invention, the air stream is bent off by the lower edge of the reclaiming wall, which lower edge is provided at some distance above the liquid level in the tank, whereas the bent-off air is aspired by a suction box, which is provided directly behind the reclaiming wall and which is connected to an exhaust fan.

As explained above, the paint particles present in the air stream will end up for the greater part in the liquid tank when the air stream is bent off. However, the particles bent off with the air stream still have to pass through the liquid film, which flows into the tank from the lower edge of the reclaiming wall, so that in fact the bent-off air stream is filtered by the liquid film. It is prevented by the positioning of the exhaust fan that a part of the air stream is bent off in the direction of the object to be treated.

Furthermore, the liquid tank has an essentially vertical partition which, in the same direction as the reclaiming wall, extends itself from a certain distance from the bottom of the tank to above the liquid level therein, in such a way that it separates a part of the tank lying outside the air stream, the reclaiming wall and the suction of the circulation pump.

It appeared surprizingly that precisely in this screened-off part of the tank it is possible to obtain a strong concentration of the material particles, which have been brought into the tank by the air stream and the liquid flow along the wall. When the device is stopped for some time, e.g. during the night, a thick skin forms itself on this screened-off part, which skin can be removed easily from the liquid surface.

According to a further elaboration of the invention, two devices may be set up symmetrically with respect to each other in a working space, in such a way that the two active surfaces of the two reclaiming walls are directed towards one another.

The two persons who are spraying paint e.g., are then standing with their backs turned towards one another. This was not possible with the known devices, because then two oppositely directed air streams would have to be generated which, of course, is impossible.

Such a set-up of two devices makes it possible to move an object, of which the one side has been treated at the one device, in cross direction towards the other device, where the other side of this object is treated. This avoids cumbersome manoeuvring with large objects.

In special cases it is also possible to treat objects which have parts that protrude far in a direction across the reclaiming wall. In that case, use can be made of the space, which in principle is meant for the oppositely situated device, which then remains out of operation. With the known devices, however, one is always restricted to dimensions of the object, for which the device was designed. With the set-up of two devices as described above, the working space is used optimally.

Figure 1:
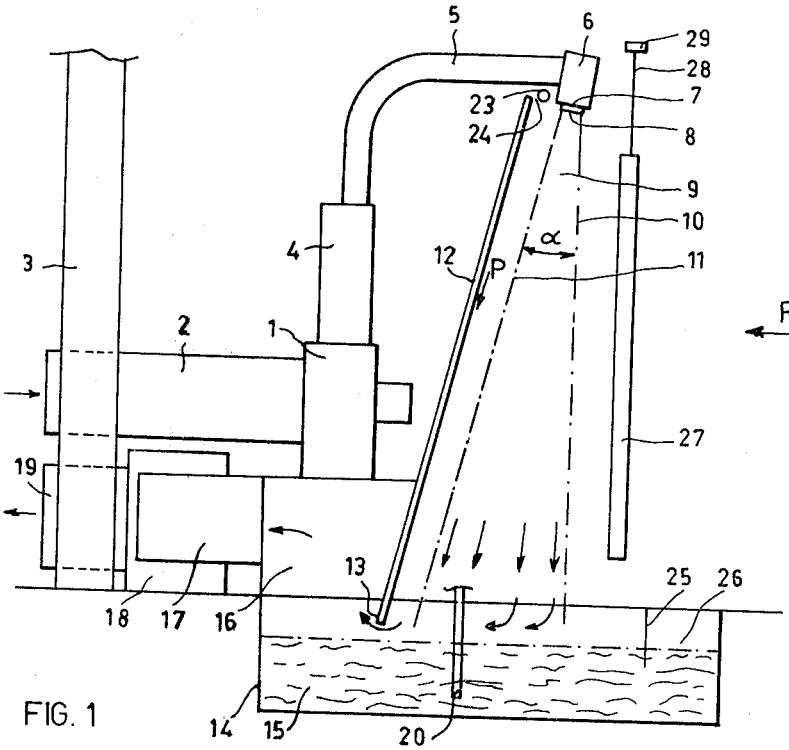
Figure 3:
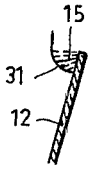

The invention will be explained in the following with reference to an example of an embodiment shown in the drawing, in which:

FIG. 1 gives a schematical lateral view of a device according to the present invention, FIG. 2 gives a schematical top view of the device of FIG. 1, and FIG. 3 gives a sectional view of the upper edge of the reclaiming wall showing a different way for bringing liquid thereon.

The embodiment shown comprises a fan 1, which by means of a suction pipe 2 aspires air from outside a building 3 and conveys it to a distributor 4. From the distributor 4, the air is supplied through lines 5 to the distributing box 6, which in the shown embodiment is divided into four parts, which are provided each at the underside with an outlet opening 7, with guiding partitions 8 therein.

These guiding partitions may be of a known type available on the market and may be carried out in such a way, that an air stream 9 is obtained with relatively sharp limitation planes 10 and 11.

It appears that in practice partitions can be used, which assure an angle $\alpha$ between the limitation planes 10 and 11 of about 14°. In that case the limitation plane 10 will be directed almost vertically.

Parallel to the limitation plane 11 a reclaiming wall 12 has been provided, which is at some distance from the limitation plane 11. The lower edge 13 of the reclaiming wall 12 is situated in a tank 14 with therein the liquid 15.

The air stream 9 is bent off along the lower edge 13 of the reclaiming wall 12 and enters the suction box 16, which by means of lines 17 is connected with the exhaust fan 18, which evacuates the air through the exhaust pipe 19.

It is possible, of course, to connect the exhaust pipe 19 to a cyclone or to a filtering device, to remove particles which may still be present in the air.

The entire air circulation has been shown by means of arrows, which are not provided with reference numbers.

To the tank 14 is connected the suction pipe 20 of a circulation pump 21. Through the line 22, the circulation pump 21 conveys liquid to the distributing pipe 23, from which the liquid is sprayed on the wall 12 by means of spraying nozzles 24. The liquid runs down the wall 12, as indicated by the arrow P. At the lower edge 13 of the reclaiming wall 12 the liquid drips off the wall to re-enter the tank 14. As shows FIG. 1, the bent-off air stream 9 will pass through the water film running down the wall 12.

The water tank 14 furthermore comprises the partition 25, which extends itself partly in the liquid, so that in the tank a part 26 is formed, where no strong liquid circulation will occur.

The drawing shows an object 27, which may e.g. be formed of a window frame and which must be painted e.g. by means of spraying. The spraying takes place in the direction indicated by the arrow R.

The supply of the object 27 to the device takes place by means of suspension devices 28, connected with a horizontal conveyor 29. By means of the conveyor 29, the objects 27 are brought to the device in the direction of the arrow S.

As explained above, it is possible to provide two of the above-described devices in a working space, in such a way that the active surfaces of the reclaiming walls are directed towards one another. The conveyors 29 of the two devices may then be provided with mutual cross connecting pieces 30, in such a way that a treated object 27 can be moved at a right angle to its plane in the direction of the arrow T towards the other device, where the other surface can then be treated. Thus the two-sided treatment of large objects is greatly simplified.

FIG. 3 shows another possibility for bringing liquid 15 on the reclaiming wall 12. In this case the pipe 23 ends into a gutter 31, one side wall of which is formed by the reclaiming wall 12 so that the liquid 15 which is flowing into the gutter 31 will flow over the upper edge of the wall 12 and will run down along this. The gutter 31 is provided with end walls which are not shown in FIG. 3.

It will be obvious that in the above and in the drawing only one possible embodiment has been described, and very schematically at that. It will be obvious to the expert that numerous additions can be made, without modifying the principle of the present invention. It is possible e.g. to provide the tank 14 for the liquid with a level regulator, as always some evaporation of liquid may occur and thus new liquid must be added from time to time or possibly continuously. Furthermore, the tank may be provided with a draining connection for cleaning purposes and the like. The removal of the materials gathered in the tank may be made automatical, etc.

Although, as said above, the device can be used in particular for spraying paints and varnishes, in which case water can be used as a liquid, the device can also be made suitable for different surface treatments, where use can be made of course of another liquid and where of course also the material must be considered of which the reclaiming wall is made.

We claim:

1. An apparatus for reclaiming sprayed paint which does not land on an article to be painted, said apparatus comprising:

at least one fan means for generating an air stream;

at least one inclined reclaiming wall, located past the article to be painted in the direction of sprayed paint, said reclaiming wall is inclined toward said article to be painted at an angle of between 10° and 20° with the vertical plane;

a distribution box means, connected to said fan means, for directing said air stream in a narrow stream between said wall and said article, said narrow stream defined by two planes forming an acute angle of between 10° and 20° with each other, one of said planes substantially parallel to said reclaiming wall and the other of said planes substantially vertical, said narrow stream located a distance from said wall;

a liquid tank with liquid therein, located substantially under said reclaiming wall;

a distribution device means for applying said liquid to said reclaiming wall and forming a sheet of liquid flowing down said wall between said wall and said air stream;

pump means for circulating said liquid from said tank to said distribution device.

2. Device according to claim 1, wherein the angle of the reclaiming wall is 14°.

3. The apparatus of claim 1, wherein there is further included a suction box having an exhaust fan connected thereto, and further said reclaiming wall is spaced apart from said liquid in said liquid tank, said suction box connected to said reclaiming wall and liquid tank so as to provide a suction in the vicinity of the space between said reclaiming wall and said liquid tank, said suction box and space between said reclaiming wall and liquid in said liquid tank comprising means for aspiring said air stream.

4. An apparatus according to claim 1, wherein said liquid tank includes a vertical partition therein extending above said liquid, said vertical partition comprising means for separating a portion of said tank lying outside the vicinity of said air stream from a portion of said tank in the vicinity of said air stream and said aspiration means.

* * * * *